United States Patent [19]

Uyeda

[11] Patent Number: 4,588,115

[45] Date of Patent: May 13, 1986

[54] SKI AND SKI POLE CARRIER AND SNOW SCRAPER

[76] Inventor: Mark H. Uyeda, 3360 Topaz La., J-15, Fullerton, Calif. 92631

[21] Appl. No.: 710,106

[22] Filed: Mar. 11, 1985

[51] Int. Cl.[4] ..... A63C 11/02

[52] U.S. Cl. ..... 224/218; 224/917; 294/147

[58] Field of Search ..... 294/153, 147, 150, 151; 224/917, 107, 218; 24/70 R, 70 ST, 71 T

[56] References Cited

U.S. PATENT DOCUMENTS

| | | | |
|---|---|---|---|
| 867,518 | 10/1907 | Mark | 24/70 ST |
| 2,174,345 | 9/1939 | Worthing | 24/71 TT X |
| 3,114,487 | 12/1963 | Miller et al. | 294/147 |
| 3,486,672 | 12/1969 | Esopi | 294/147 X |
| 3,718,242 | 2/1973 | Larson | 294/147 |
| 3,905,610 | 9/1975 | Dini | 294/147 X |
| 4,361,347 | 11/1982 | MacIntyre | 224/917 X |
| 4,494,787 | 1/1985 | Gainey | 224/917 X |

FOREIGN PATENT DOCUMENTS

| | | | |
|---|---|---|---|
| 2431396 | 2/1980 | France | 224/917 |
| 273106 | 1/1951 | Switzerland | 224/917 |

*Primary Examiner*—Stephen Marcus
*Assistant Examiner*—Robert Petrik
*Attorney, Agent, or Firm*—Ben E. Lofstedt

[57] ABSTRACT

The invention disclosed herein is concerned essentially with a carrier for a set of skis and poles wherein is provided a pair of first adjustable, flexible bands with an over-center latch and ski-holding bracket assembly containing a lever with an ice-pick or screwdriver head for binding the pair of skis together to form a unified, compact unit, a pair of second flexible bands for adjustably capturing the ski poles with interconnecting members for coupling the complementary pair of first and second bands together to form a carrier for the skis and ski poles whereby the entire combination is manually carried by mediately gripping the bound ski poles, and a snow and/or debris scraper formed as an integral part of the over-center latch and bracket assembly.

6 Claims, 9 Drawing Figures

SKI AND SKI POLE CARRIER AND SNOW SCRAPER

BACKGROUND OF THE INVENTION

1. Field of the Invention:

The instant invention relates to a combination carrier and binding system for a plurality of enlongated elements, and, more particularly, to a compact carrier for a pair of ski poles and skis which may be easily carried in the skier's pocket readily available for convenient use as needed.

2. Description of the Prior Art:

It is well known that skis and ski poles are elongated units which are cumbersome and difficult to conveniently transport when not being used. In order to overcome this troublesome problem and difficulty, a number of prior art ski and ski pole carriers have been suggested.

However, it would appear that such ski and ski poles carriers have not been generally accepted because they generally involve relatively complex procedures for engagement with and disengagement from the skis and ski poles, not retaining the ski poles in a suitably secured manner together with the skis, and having substantial bulk so as to be inconvenient to carry on the person when not in use.

Additionally, in order to properly secure the pair of skis as close as possible for convenient carrying purposes, chunks of snow and other debris must first be removed before the skis can be compactly bound together.

Additionally, none of the prior art devices provide a snow or debris scraping means for removal of snow and debris from the skis.

The ski equipment carrier disclosed in U.S. Pat. No. 3,114,487 (Miller, et al.) (1963) includes a relatively large tubular frame A, with handle B, which may be grasped by one hand C of the user, and has two connectors D extending downwardly from the ends thereof. A pair of parallel J-shaped rigid members E are provided which act as a cradle to hold and support a pair of skis G which are held therein in a spaced-apart condition by the use of a block F. Closure straps are mounted to the frame A, at appropriate locations thereon, to captively hold a pair of skis G and ski poles H. Short lengths of rope or resilient bands serve as fasteners H to bind the ends of the skis G to both fasten the ends of the pair of skis G together and to provide the biasing force to press the skis G against the spacing block F. While this ski equipment carrier will function as claimed, it is too bulky to be conveniently carried by the user on the snow slopes. After the skis and ski poles are removed therefrom, the user must now locate a safe place in which to store his or her ski equipment carrier following its use. In essence, this literally means that the ski equipment user, after removing his skis, must now carry this unweldy ski equipment to the safe location where the ski equipment carrier is located. Not only is it bulky, it is costly to manufacture as well.

U.S. Pat. No. 3,486,672 (Esopi) (1969) relates to a ski-and-pole carrier wherein are provided a pair of separate holders each having relatively large loop means for snugly receiving the skis and relatively small loop means for snugly receiving the ski poles. Basically, this ski-and-pole carrier 10 depends upon the use of resiliently distensible construction, as by integrally molding from resilient plastic, rubber or other suitably elastic material. While this carrier is suitable for compactly carrying same on the ski user's person, a number of problems are posed by the use of this device:

(1) It must be constructed of resilient elastomeric material, such as plastic or rubber, which is not known for its elastic durability under extreme cold temperature conditions.

(2) The carrier must be joined at 31 by a connection portion. Should this break, the carrier 10 will no longer function as a carrier. Elastomers are noted for their weakness under stretched conditions, and even more so under extreme cold.

(3) The use of an over-center latching mechanism to lock the elements in place requires that the elastomeric substances be stretched as a condition for achieving lock-up to capture the ski equipment for carrying or transport. Use of an elastomeric substance is undesirable for use in cold, when stretched, because it is highly prone to catastrophic fracture under such conditions.

(4) The use of the elastomeric substance in conjection with the metal rings 21, 26, 43 and 44 require that the rings be open at the ends embedded in the elastomeric material. Because of this, if the elastic material is overstretched or fails under load due to the extreme cold, the rings will either "pop" loose or because of the fracture, become disengaged therefrom and be rendered useless.

U.S. Pat. No. 4,173,811 (Kokeisl) (1979) relates to a ski-tie device which comprises a flat housing 1 from which an elastic band 3 can be withdrawn laterally to engage a similar device on another ski of the pair. Integral with the elastic band 3 is a pair of resilient strips 6 anchored in the housing 1 and the band 3 is provided with an abatement engageable with an abutment of the housing 1 to prevent excessive stretching of these strips 6 when the band 3 is withdrawn from the housing 1 and stretched. This device is rather complex in its construction and is disadvantaged by the use of elastic strips 6 and band 3 for the reasons hereinbefore discussed. This device is intended to always remain on the ski and not to be removed therefrom.

While not directed specifically to ski equipment carrying devices, the following U.S. patents are pertinent to the subject matter of the present invention in that each relates to fastener/buckle systems which are similar to that use by the ski equipment carrier presented and disclosed herein U.S. Pat. No. 867,518 (Mark), U.S. Pat. No. 1,023,639 (Graham), U.S. Pat. No. 2,835,015 (Emmins), U.S. Pat. No. 3,475,793 (Oetcker), and U.S. Pat. No. 4,453,290 (Riedel).

None of the ski equipment carriers found in the prior art and disclosed herein have been accepted by the ski-using enthusiast because of the disadvantages discussed herein as well as lacking the highly desirable additional features disclosed hereinafterwards offered by the present invention herein.

SUMMARY OF THE INVENTION AND OBJECTS:

Fundamentally, the present invention generally referred to herein as a ski and ski pole carrier, ice pick/-screwdriver and snow scraper, including a pair of first adjustable, flexible bands with an over-center latch and ski-holding bracket assembly containing a lever with an ice-pick or screwdriver head for binding the pair of skis together to form a unified, compact unit, a pair of second flexible bands for adjustably capturing the ski poles with interconnecting means for coupling the complementary pair of first and second bands together to form a carrier for the skis and ski poles whereby the entire combination is manually carried by mediately gripping the bound ski poles, and a snow and/or debris scraper formed as an integral part of the over-center latch and bracket assembly.

It is one primary object of the instant invention to provide an improved ski equipment carrying device for the pair-wise interconnection of skis and ski poles.

Another important and primary object of the instant invention is to provide a highly improved ski carrier which overcomes the disadvantages of the prior art devices, effectively maintaining the ski poles and skis in a secure relationship, which carrier is relatively light in weight.

It is yet a still further object of the unique invention disclosed and described herein to provide a ski and ski pole carrying device which is adapted to occupy a minimum of space for convenient storage, when not in use, in, for example, a skier's pocket.

It is another important and highly desirable object of the within described invention to provide a ski equipment carrier which is extremely simple to apply to and remove from the skis and ski poles, the poles affording a convenient handle for manual portability of the skis and ski poles.

A yet still further important object of the invention is to provide a ski carrying device which is durable and long lasting and does not employ the use of rubber (or other elastomeric substances) straps which are prone to harden and crack after a year or two and fail.

It is another important and primary object of the invention herein to provide a ski and ski pole carrier which is readily adaptable to being used in conjunction with a shoulder strap.

Another and further and primary object of the invention is to provide a ski-carrying device which incorporates a means to scrape caked snow off skis and boots, aid in unbuckling frozen boot buckles, loosen or tighten ski binding adjustment screws, and to break-up caked ice on skis, boots and/or bindings.

It is yet another object of the present invention to provide a ski-and-pole carrier having the advantages and characteristics mentioned in the preceeding, which is extremely simple in construction and which can be economically manufactured for sale at a reasonable price.

Other, and further, objects of the present invention will become apparent upon reading the following specification and referring to the accompanying drawings, which form a material part of this disclosure.

The invention accordingly consists in the features of construction, combinations of elements, and arrangement of parts, which will be exemplified in the construction hereinafter disclosed, and of which the scope will be indicated by the appended claims.

The same will become even more increasingly clear from the accompanying drawings illustrating the same, in which:

DESCRIPTION THE PREFERRED EMBODIMENT OF THE PRESENT INVENTION

Figure 1:
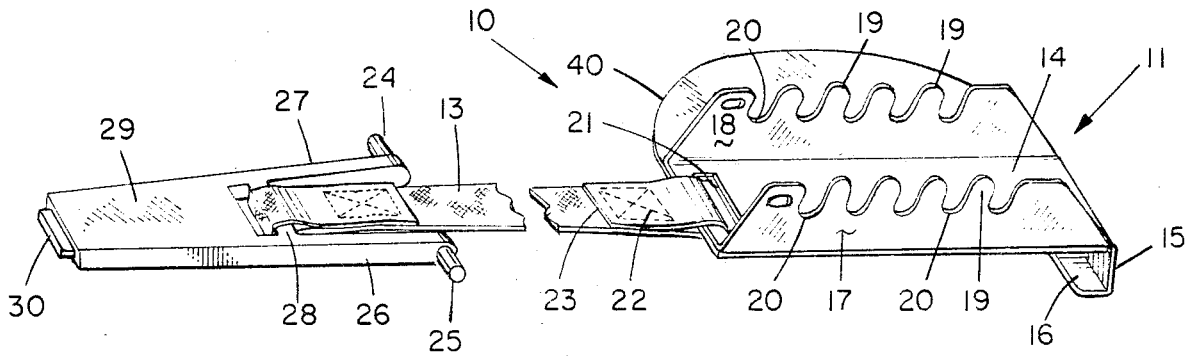
FIG. 1 is a perspective view of the improved ski and ski pole carrier characterizing the present invention.
Figure 7:
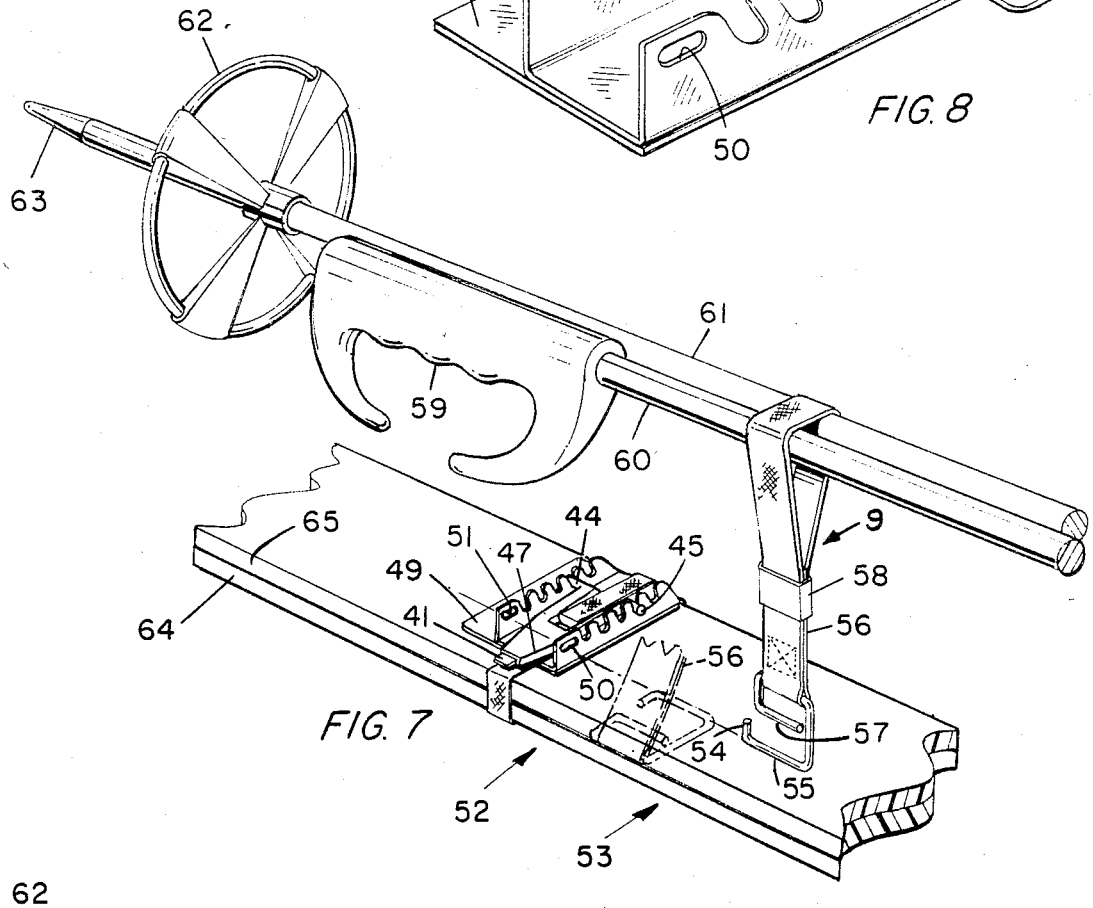
FIG. 7 is an enlarged view, shown partially in cutaway form of the latched pair of skis together with the looped strap about the pair of ski poles, detailing the manner and method of engagement between the latch-up means for the skis and the ski poles latch-up means.

With continued reference to all of the drawings herein, and, with particular emphasis now on FIG. 7, when viewed in combination with the greater detailed references of FIG. 1, there is depicted therein the present invention, generally shown at 9 and 10, an improved combination skis and ski poles carrier, snow scraper, ice pick, and ski boots and binding adjustment system, including a duplex rack, generally indicated at 11, including a base 14, the base 14 having four sides with a pair of rack elements 17, 18 projecting upwardly from the elongated sides of the base 14, each of the rack elements 17, 18 having a plurality of teeth 19 thereon, and a bracket 15 disposed on one of the other sides and an aperture 21 in the base 14. The aperture 21 being disposed adjacently to the remaining side of the base 14 opposite the side containing the bracket 15, a now and/or debris scraping element 40 projecting laterally outwardly from the base 14, a flexible strap 13 of cloth material, one end of which is captively looped through the aperture 21 in the base 14, the other end of the strap 13 being looped for captive engagement with a latching lever 29 having an aperture therein created by a bridging element 28 spanning a pair of legs 26, 27 disposed in substantially parallel fashion to one another, the extremities of which have a pair of outwardly extending pegs 24, 25 and a screwdriver head 30 formed at the opposite end of the lever 29 away from the pair of legs 26, 27.

The screwdriver head 30 on the lever 29 depicted in FIG. 1 is useful for adjusting the ski bindings for proper engagement with the ski boots.

Figure 5:
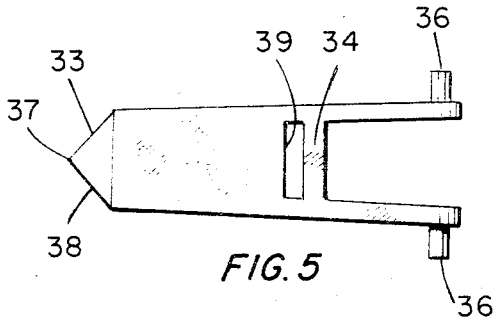
FIG. 5 is a top view of the one embodiment of the combination ice pick and over-center lever which is a part of the latching mechanism of the present invention.
Figure 3:
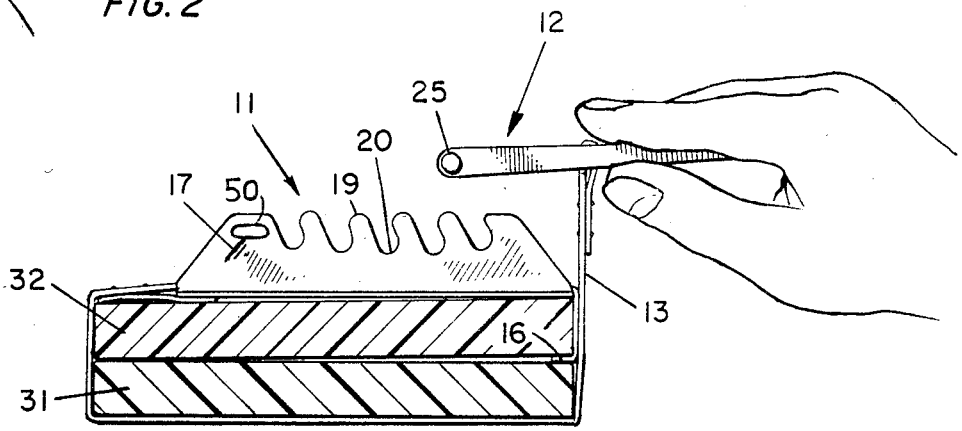
FIG. 3 is an enlarged cross-sectional view of the ski carrier depicting the captivation of a pair of skis therein immediately prior to latch-up using the adjustable fastner.

Another embodiment of the latching lever 29 is depicted in FIG. 5, which is similar to that depicted in FIG. 1 with the exception that an ice pick head, comprised of a pair of complementary angled sides 33, 38 and a sharp point 37, is formed at the end of the lever 29 instead of the screwdriver head 30 shown in FIG. 1. As shown, the lever includes an aperture 39, a bridging element 34, and a pair of laterally-extending pegs 36 which are formed as part of a pair of legs, said legs being similar in shape and function as legs 26, 27 shown in FIG. 1. Either embodiment of the lever 29 can be employed with equal success.

Figure 2:
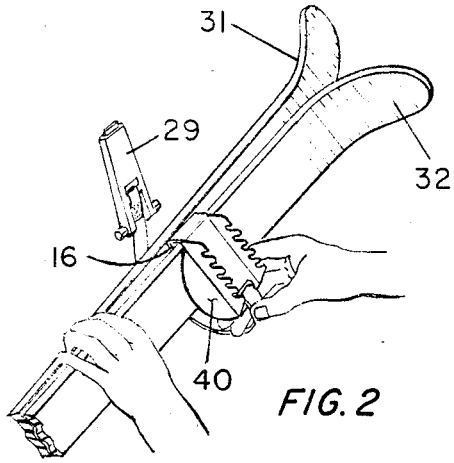
FIG. 2 is a perspective illustration showing the manner in which the present invention is positioned with respect to the skis immediately prior to captively securing the ski carrier thereabout.

Turning now to FIG. 2 of the drawings, there is shown and illustrated the technique for initial engagement of the bracket tang 16 of the bracket 15 with the elongated edge of one of the skis 32 to be bound together. Once the bracket 15 and the tang 16 is engaged with the edge of the ski 32, the strap is looped around the ski 32, then about ski 31, and the end of the lever 29 arranged for engagement with the complementary teeth 19 of the duplex rack 11, having rack elements 17, 18 thereon, as generally depicted at 12.

Figure 4:
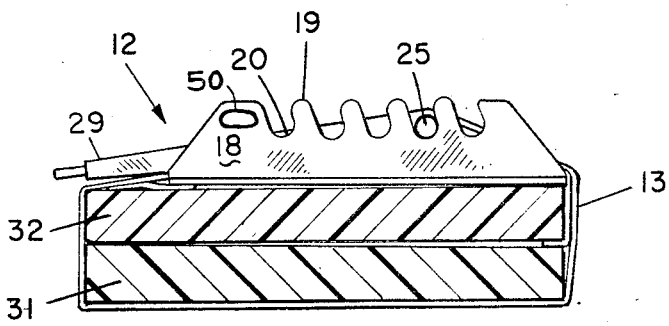
FIG. 4 is similar to FIG. 3 with the exception that it depicts the latch-up as completed.

The lever 29 is then brought into a latching position, as shown in FIG. 4, by directing the pegs 24, 25 into the slotted portions 20 disposed inbetween the teeth 19. Once engagement is accomplished, the lever is manually directed into position 12, and the over-center latching action is completed with the strap 13 being brought into a very tauntily wrapped engagement about said skis 31, 32. This completes the binding of the two skis 31, 32 into intimate engagement with one another.

Figure 6:
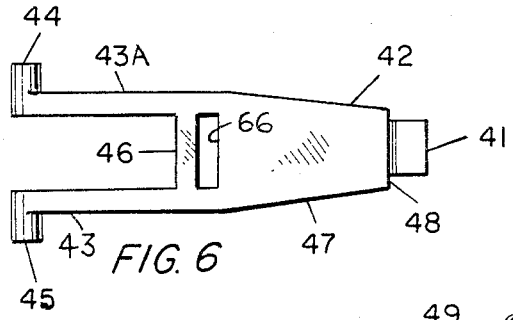
FIG. 6 is another embodiment of the combination binding adjustment/screw driver and over-center lever which forms a part of the latching mechanism of the present invention.

With special reference now to FIG. 6, there is shown a slightly modified lever than that lever 29 previously described herein. This lever has a pair of straight, parallely-disposed to one another legs 43, 43A, with a bridging element 46 formed therein to create an aperature 66 for the looped strap 13 to be operably coupled thereto. A pair of tapered edges 42, 47 form the forward portion of this lever with a very much extended screwdriver head 41 projecting from the end 48 thereof.

Figure 8:
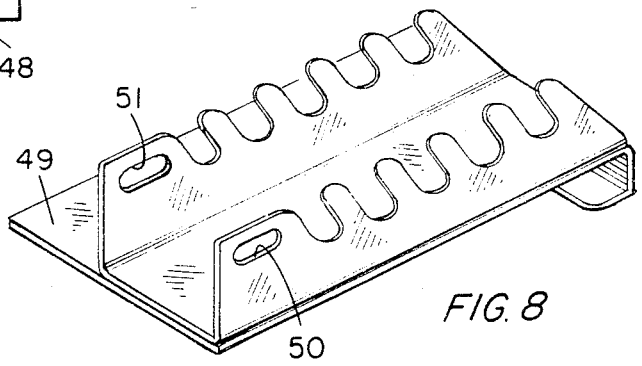
FIG. 8 is a perspective view of the duplex toothed rack in combination with the ski edge capturing bracket and the snow and debris scraping element.

Turning now to FIG. 8 of the drawings, there is shown another embodiment of the duplex rack, the primary difference between the duplex rack of FIG. 1 and this one being the use of a square edged snow and/or debris scraping edge 49 incorporated thereinto. Often times, a square edged scraping edge 49 is preferred over a rounded edge 40 as depicted in FIG. 1.

The remaining element of the present invention is the ski poles banding and duplex rack intercoupling element generally indicated at 9 in FIG. 7.

This element 9 includes a double looped strap 56, one loop of which is passed over the pair of ski poles 60, 61 and then tightened by pushing the loop tightening element 58 towards the ski poles 60, 61, thereby closing down the loop about the ski poles 60, 61. The other loop formed at the opposite end of the strap 56, is arranged for engagement with a coupling device consisting of a wire element 57 which includes an engaging element 55 and a locking stub 54.

Once the ski binding element is secured, the element 9 is brought into coupling engagement therewith by first positioning the engaging element 55 into a relatively flatened position against the ski as depicted generally, in phantom limes, at 52. This is done so that the locking stub 54 can be easily passed through the elongated slots 50, 51 in the duplex rack. Once this is accomplished, the engaging element 55 and the locking stub 54 is rotated back to the position depicted generally at 53.

This disposes the locking stub 54 into a position where it cannot now be withdrawn from the elongated slots 50, 51 of the duplex rack.

Additionally, the engaging element 55 acts to bridge the lever 29 which when positioned in its latched position as shown in FIG. 7 will act to prevent the lever 29 from flipping out of its over-centered position and unlocking the latch, thereby acting as a safety mechanism to prevent unintentional unlocking of the mechanism.

Figure 9:
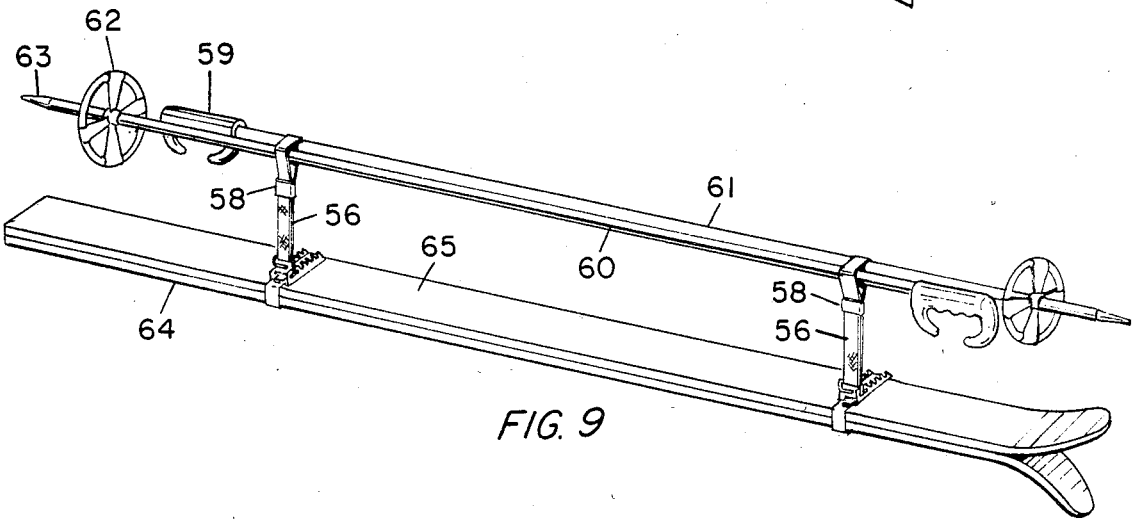
FIG. 9 is a perspective view of the present invention shown in its ready-to-carry the skis and ski poles mode wherein the skier will carry same by gripping the median portion of the pair of latched ski poles.

As depicted in FIG. 9, the entire combination of skis 64, 65 and ski poles 60, 61 can be carried by the ski user by simply manually gripping the ski poles 60, 61 mediately for easy transportation of the entire assemblage as a unified structure.

While the present invention has been definitively described in great detail herein, it should be noted and understood that the Applicant does not intend to be restricted to this particular, preferred embodiment of his invention, it being clearly understood that the invention disclosed herein is capable of embodiments which are different than that which is disclosed herein, the spirit and scope of the invention being only limited by the breadth of the claims appended hereto.

What I claim is:

1. An improved combination skis and ski poles carrier, snow scraper, ice pick, and ski boots and binding adjustment tool, comprising:

(a) a combination ski holding bracket and duplex rack for edgewise engagement with one of the elongated sides of one of said skis, said rack including an elongated base disposed in intimate face-to-face relationship with one of the skis and having four sides with a pair of rack elements projectiong upwardly from the elongated sides of the base and away from the ski, each of the rack elements having a plurality of complementarily-arranged teeth thereon, with a pair of elongated, oppositely-disposed, complementary slotted portions therein, said bracket disposed on another one of the remaining sides of the base, and an aperture in the base adjacently disposed to the remaining end of the base, oppositely disposed to the bracket;

(b) an elongated scraping element disposed adjacent to said one of said skis and projecting laterally outwardly from the base to serve as a tool for manually scraping snow and/or debris from the skis when the bracket and duplex rack is disengaged from said ski;

(c) a flexible strap formed of cloth material, the oppositely-disposed ends thereof being formed into loops, one loop being captively disposed within the aperture in the base of the duplex rack;

(d) a latching lever and ski boot binding adjusting tool, said lever having a pair of latching legs and a handle thereon and an aperture therein created by a bridging element spanning said pair of legs and being anchored at its extremities to the body of the latching lever and disposed in substantially parallel fashion to one another, the extremities of which have a pair of outwardly extending pegs adapted to operably mate with the complementary slots in said rack and a screwdriver head formed at the opposite end of the lever from the pair of legs, said bridging element being adapted for operative disposition within the free loop of said flexible strap, thereby coupling the latching lever and ski boot binding adjustment tool to the ski holding bracket and duplex rack whereby when the bracket is mounted on the face and edge of one ski and the flexible strap is wrapped around the two skis disposed in lateral, face-to-face relationship, so that the pegs are inserted into the slots of the rack to operatively engage the teeth of said rack and as the handle of the latching lever is manually brought over and into nesting engagement between the upstanding, outwardly directed pair of racks, an over-center latching action occurs and binds the two skis together;

(e) a second double looped strap of cloth material, the first looped portion having a slideable loop tightening means used for tightening the loop about a pair of ski poles when said ski poles are disposed therein;

(f) a coupling device consisting of a wire element which includes an engaging portion and a locking stub, and a loop retention portion, the loop retention portion being engageable with the second looped portion of the second double looped strap, and the engaging portion being adapted to be insertable into a complementary pair of slotted portions in the duplex rack, with the locking stub serving to prevent undesirable withdrawal from the slotted portions following engagement therewith.

2. The device of claim 1 wherein said cloth material is a man-made fiber.

3. The device of claim 1 wherein the bracket of said duplex rack is adapted for edge-wise engagement of one of the elongated sides of said skis.

4. The device of claim 1 wherein said elongated scraping element has an arcuately shaped peripheral portion thereon.

5. The device of claim 1 wherein said elongated scraping element has a straight forwardmost edge thereon.

6. The device of claim 1 wherein the latching lever has one end shaped in an arrow form to serve and function as an ice pick.

* * * * *